US007031641B2

(12) United States Patent
Nakahara et al.

(10) Patent No.: US 7,031,641 B2
(45) Date of Patent: Apr. 18, 2006

(54) IMAGE-FORMING APPARATUS HAVING PRE-CHARGE EXPOSURE DEVICE FOR IMAGE CARRIER

(75) Inventors: Hisashi Nakahara, Tokyo (JP); Yasunori Chigono, Tokyo (JP); Yasuhiro Nakata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 169 days.

(21) Appl. No.: 10/835,303

(22) Filed: Apr. 28, 2004

(65) Prior Publication Data

US 2004/0223784 A1 Nov. 11, 2004

(30) Foreign Application Priority Data

May 8, 2003 (JP) ..... 2003/129880
Apr. 6, 2004 (JP) ..... 2004/112326

(51) Int. Cl.
*G03G 21/00* (2006.01)
*G03G 15/24* (2006.01)

(52) U.S. Cl. ..... 399/129; 399/150
(58) Field of Classification Search ..... 399/50, 399/129, 149, 150, 168, 169, 174, 175

See application file for complete search history.

(56) References Cited

U.S. PATENT DOCUMENTS 5,933,681 A * 8/1999 Suzuki ..... 399/50
6,442,362 B1 * 8/2002 Hirabayashi et al. ..... 399/149

FOREIGN PATENT DOCUMENTS

JP 10-307454 A 11/1998
JP 10-307455 A 11/1998
JP 10-307456 A 11/1998
JP 2003-043822 A 2/2003

* cited by examiner

*Primary Examiner*—Arthur T. Grimley
*Assistant Examiner*—Ryan Gleitz
(74) *Attorney, Agent, or Firm*—Canon U.S.A. Inc I.P. Div.

(57) ABSTRACT

An image-forming apparatus includes a pre-charge exposure device which removes electric charge from a photoconductor drum to increase a potential contrast between the surface of the photoconductor drum and the surface of a charge roller in an upstream region of a nip region between the photoconductor drum and the charge roller in the rotating direction of the photoconductor drum, so that toner accumulating in an upstream region of the nip region in the rotating direction of the photoconductor drum is restrained and prevented from being discharged onto an image-forming region. When the toner accumulating in the upstream region of the nip region in the rotating direction of the photoconductor drum is to be discharged onto a non-image-forming region, the pre-charge exposure device is turned off so that the potential contrast decreases.

24 Claims, 6 Drawing Sheets

IMAGE-FORMING APPARATUS HAVING PRE-CHARGE EXPOSURE DEVICE FOR IMAGE CARRIER

BACKGROUND OF THE INVENTION

1. Field of the Invention

The present invention relates to image-forming apparatuses, such as copy machines and printers, and more specifically relates to an image-forming apparatus which uses a contact charge method and a transfer method and performs a toner-recycling process.

2. Description of the Related Art

A typical image-forming apparatus performs an electrophotography process including the basic steps of charging, exposure, development, transfer, and fixing. More specifically, a charging device uniformly charges the surface of a rotating photoconductor and an exposure optical system irradiates the charged surface of the rotating photoconductor so as to form an electrostatic latent image on the photoconductor. The electrostatic latent image moves toward a development section as the photoconductor rotates, and is developed by a development device so that a developer image (toner image) is formed on the photoconductor. Then, the toner image is conveyed to a transfer section and transferred onto a recording sheet by a transfer unit, and the recording sheet is conveyed toward a fixing device. At this time, some toner remains on the photoconductor after the transfer step, and moves toward a cleaning device as the photoconductor rotates. The toner remaining on the photoconductor after the transfer step is called residual toner, and is collected by the cleaning device to prepare for the next cycle.

One known charging device uses corona discharge to charge the photoconductor. However, this device operates at a high voltage, and therefore inevitably produces an unpleasant ozone smell. In addition, this device includes a corona discharge unit, which is relatively large and requires a high-voltage power source. Accordingly, charging devices have recently been put to practical use which include a conducting roller or a conducting brush and use a contact charging method in which the photoconductor is sufficiently charged at a lower voltage and with lower ozone production compared to those using corona discharge.

In the above-described charging devices using the contact charging method, the surface of the photoconductor is charged to a predetermined potential with a predetermined polarity by applying a voltage to a charging member which is in contact with the photoconductor.

In addition, in the above-described charging devices using the contact charging method, the surface of the photoconductor may also be charged by direct charge injection in which electric charge is directly injected into the photoconductor via the charging member. In direct charge injection, the surface of the photoconductor is charged without causing electric discharge, using a medium-resistance charging member, such as a charge roller, which is in contact with the surface of the photoconductor. In this method, ions are not generated, and adverse effects due to discharge products are avoided accordingly.

On the other hand, although the residual toner is collected by the cleaning device and processed as waste toner, the waste toner is preferably not generated in view of environmental preservation.

Accordingly, image-forming apparatuses have recently been put to practical use which are free from the above-described cleaning device and which perform a toner-recycling process by a "simultaneous development and cleaning" method in which the residual toner remaining on the surface of the photoconductor is collected and reused by a development device.

In the "simultaneous development and cleaning" method, the residual toner remaining on the photoconductor after the transfer step is collected in the development step of the subsequent cycle, that is, when the latent image formed on the photoconductor is developed, by applying a back bias (back potential difference $V_{back}$ equal to the difference between the potential of a direct voltage applied to the development device and the potential on the surface of the photoconductor).

In this method, the residual toner remaining on the photoconductor after the transfer step is collected and reused in the following cycle so that the waste toner is not generated, and therefore the running cost of the printing operation is reduced. In addition, the cleaning device can be omitted and it is not necessary to provide a space for the cleaning device, so that the size of the image-forming apparatus is greatly reduced.

The inventors of the present invention have proposed image-forming apparatuses which perform the above-described toner-recycling process in Japanese Patent Laid-Open Nos. 10-307454, 10-307455, and 10-307456.

In these image-forming apparatuses, however, the charge roller often picks up substances like the residual toner adhering to the photoconductor since it is in contact with the surface of the photoconductor to charge the surface of the photoconductor, and therefore the charge roller is easily contaminated. When the charge roller is excessively contaminated, uniform charging cannot be achieved and the charging performance is degraded. In addition, in the above-described image-forming apparatuses which are free from the cleaning device and which perform the toner-recycling process (cleaner-less process), the residual toner and the like accumulates on the charge roller or in a region near a nip region between the photoconductor and the charge roller when the image-forming operation is continuously performed. This is because the residual toner has the same polarity as that of the charge roller and easily accumulates in an upstream region of the nip region in the rotating direction of the photoconductor.

When the residual toner accumulating in the nip region is discharged while an image is being formed, it will block exposure if it is in a black or halftone region of a graphic pattern or the like and causes an image defect. In addition, if the discharged toner is in a white region, it causes other kinds of image defects such as fogging.

SUMMARY OF THE INVENTION

An object of the present invention is to provide an image-forming apparatus which prevents image defects caused by residual developer.

Another object of the present invention is to provide an image-forming apparatus which prevents contamination of a rotating charging member.

Another object of the present invention is to provide an image-forming apparatus in which the developer moves onto an image carrier from the charging member at a suitable time.

Another object of the present invention is to provide an image-forming apparatus in which the developer accumulating in a nip region between the image carrier and the charging member moves onto the image carrier at a suitable time.

Another object of the present invention is to provide an image-forming apparatus in which a potential difference between the image carrier and the charging member is controlled.

Further objects, features and advantages of the present invention will become apparent from the following description of the preferred embodiments with reference to the attached drawings.

DESCRIPTION OF THE PREFERRED EMBODIMENT

A preferred embodiment of the present invention will be described in detail below. However, the dimensions, materials, shapes, configurations, etc., of the components described below are not intended to limit the scope of the present invention.

Figure 1:
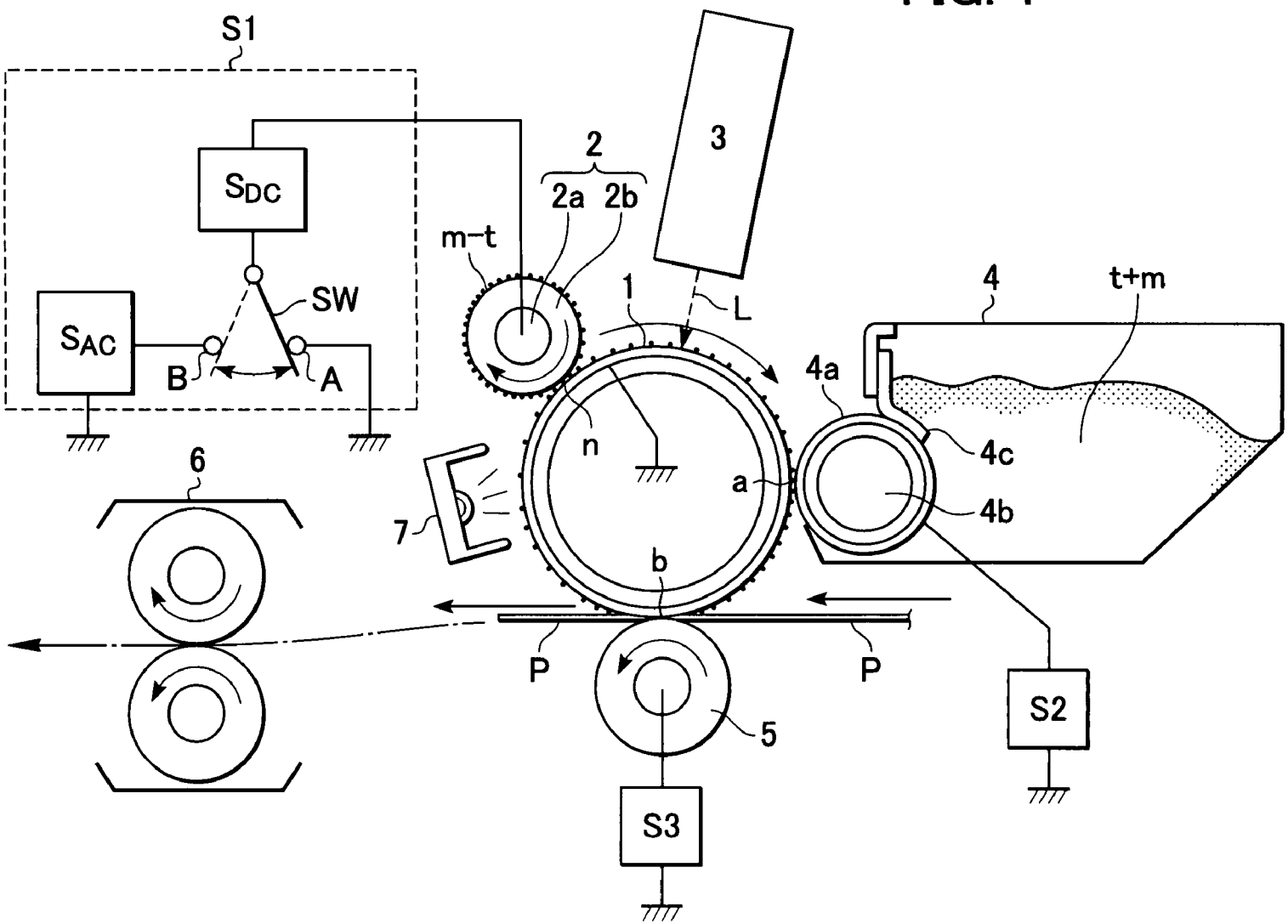
FIG. 1 is a schematic diagram showing the construction of an image-forming apparatus according to an embodiment of the present invention.

FIG. 1 is a schematic diagram showing the construction of an image-forming apparatus according to an embodiment of the present invention.

The image-forming apparatus according to the present embodiment is a laser printer which uses an electrophotographic transfer method and a contact charging method and performs a toner-recycling process.

With reference to FIG. 1, a photoconductor drum 1 functions as an image carrier and rotates in the direction shown by the arrow (clockwise in the figure). In addition, the following components are arranged around the photoconductor drum 1 along the rotating direction of the photoconductor drum 1: a charge roller 2 functioning as a rotating charging member which uniformly charges the photoconductor drum 1 while being in contact with the photoconductor drum 1 in a nip region (contact region) n; a latent-image-forming unit (latent-image-forming means) 3 which forms an electrostatic latent image on the uniformly charged surface of the photoconductor drum 1; a development device 4 functioning as a development unit (development means) which forms a toner image on the photoconductor drum 1 by reversal development of the electrostatic latent image at a development position a and carries out a "simultaneous development and cleaning" method for collecting and reusing residual toner which remains on the photoconductor drum 1 after the toner image has been transferred onto a recording medium P; a medium-resistance transfer roller 5 functioning as a transfer unit (transfer means) which is in contact with the photoconductor drum 1 in a nip region b and transfers the toner image formed on the photoconductor drum 1 onto the recording medium P at a transfer position; and a pre-charge exposure device 7 functioning as a potential-difference controller (potential changing means) which controls a potential difference between the surface of the photoconductor drum 1 and the surface of the charge roller 2 in an upstream region of the nip region n in the rotating direction of the photoconductor drum 1 at a predetermined time in a period in which an image is being or not being formed by the latent-image-forming unit 3. The pre-charge exposure device 7 is placed in an upstream side of the charge roller 2 and in a downstream side of the transfer position of the transfer roller 5 in the rotating direction of the photoconductor drum 1. The transfer medium (image-receiving medium) P on which the toner image is transferred by the transfer roller 5 is separated from the surface of the photoconductor drum, conveyed to a fixing device 6, where the toner image is fixed, and is output as an image-formed medium (printed or copied medium).

Photoconductor Drum 1

The photoconductor drum 1 is a negative-polarity organic photoconductor (OPC) having a drum shape with a diameter of 24 mm, and rotates at a constant peripheral speed of 85 mm/sec (=process speed PS or printing speed) in the clockwise direction shown by the arrow in FIG. 1.

Charge Roller 2

The charge roller 2 has a core bar 2*a* and a medium-resistance layer 2*b* composed of rubber or foam formed around the core bar 2*a*. In addition, the charge roller 2 is pressed against the photoconductor drum 1 by a predetermined pressing force such that charge roller 2 deforms elastically, and the nip region n is formed accordingly. A nip width, that is, the length of the nip region n along the circumference of the photoconductor drum 1, is about 2 mm to 3 mm. The charge roller 2 rotates such that its periphery and the periphery of the photoconductor drum 1 move in opposite directions in the nip region n (counter rotation) at a speed of about 80% of the peripheral speed of the photoconductor drum 1.

The medium-resistance layer 2*b* is composed of, for example, a resin, such as urethane and ethylene-propylene-diene monomer (EPDM), to which conductive particles such as carbon black, a sulphidizing agent, a foaming agent, etc., are added. The material of the medium-resistance layer 2*b* is not limited to an elastic foam of urethane or EPDM, and the medium-resistance layer 2*b* may also be composed of other elastic materials including rubbers, such as acrylonitrile-butadiene rubber (NBR), silicone rubber, isoprene rubber (IR), and corresponding forms, in which conductive substances such as carbon black and metal oxide are dispersed to adjust the resistance. The resistance may also be adjusted using ionic conductors instead of dispersing the conductive substances.

After the medium-resistance layer 2*b* composed of a resin layer is formed around the core bar 2*a* by injection molding or the like, the surface of the charge roller 2 is polished as necessary. The thus obtained charge roller 2 has a diameter of about 18 mm and a length of about 220 mm.

It is important that the charge roller 2 function as an electrode. More specifically, the charge roller 2 must not only be elastic so that it can be in stable contact with the photoconductor drum 1, but must also have a resistance low enough to charge the rotating photoconductor drum 1. In addition, if the photoconductor drum 1 has a low-voltage-resistance defect such as a pinhole, it is necessary to prevent a voltage leak. Accordingly, the resistance of the charge roller 2 is preferably set in the range of $10^4$ Ω to $10^7$ Ω to ensure the charging performance and leak-prevention performance. In the present embodiment, the resistance of the charge roller 2 is about 100 kΩ.

The resistance of the charge roller 2 is determined by pressing the charge roller 2 against an aluminum drum with a diameter of 24 mm such that a total load of 1 kg is applied to the core bar 2*a* of the charge roller 2, applying a voltage of 100 V between the core bar 2*a* of the charge roller 2 and the aluminum drum, and measuring the resistance between them.

In addition, the surface of the charge roller 2 preferably has micro irregularities so that the charge roller 2 can retain charge-accelerating particles, which will be described below, on the surface thereof.

With regard to the hardness of the charge roller 2, the charge roller 2 cannot have a stable shape and a reliable contact with the photoconductor drum 1 cannot be obtained if the charge roller 2 is too soft. In contrast, if the charge roller 2 is too hard, a sufficiently large nip region n cannot be provided between the photoconductor drum 1 and the charge roller 2 and the photoconductor drum 1 and the charge roller 2 cannot be in stable contact with each other from a micro point of view. Accordingly, the Asker C hardness of the charge roller 2 is preferably in the range of 25 to 50 degrees.

A charge-bias source S1 is provided for applying a predetermined charge bias to the charge roller 2. The charge-bias source S1 applies the charge bias to the charge roller 2 while an image is being recorded by the printer. Thus, the peripheral surface of the photoconductor drum 1 is uniformly charged to a predetermined potential with a predetermined polarity by a direct charge (charge injection) method. In the present embodiment, when an image is being recorded by the printer, a switch SW included in the charge-bias source S1 is connected to a contact point A so that a DC voltage of about −500 V obtained from a DC power source $S_{DC}$ is applied to the core bar 2*a* of the charge roller 2. More specifically, when an image-forming region on the photoconductor drum 1 is in the nip region n, the DC voltage is applied to the charge roller 2 and the surface of the photoconductor drum 1 is directly charged by the charge roller 2 to about −500 V, which is approximately the same as the DC voltage applied to the charge roller 2 (mode A).

Latent-Image-Forming Unit 3

The latent-image-forming unit 3 is a laser beam scanner including a laser diode, a polygon mirror, etc. The laser beam scanner 3 outputs a laser beam whose intensity is modulated in accordance with a time-series electrical digital pixel signal corresponding to a desired image information. The laser beam emitted from the laser beam scanner 3 is directed onto the charged surface of the photoconductor drum 1 at a predetermined exposure position, and thus the charged surface of the photoconductor drum 1 is scanned with the laser beam (L). Accordingly, the electrostatic latent image corresponding to the desired image information is formed on the surface of the photoconductor drum 1.

Development Device 4

In FIG. 1, the development device 4 is provided with a nonmagnetic, rotating development sleeve 4*a* which functions as a developer carrier in an opening formed at the left end of the development device 4 in FIG. 1. In addition, the development device 4 contains developer t (hereafter called toner t), which is magnetic monocomponent toner (negative toner), and charge-accelerating particles m added to the toner t. The charge polarity of the toner t is the same as the polarity of the DC voltage applied to the charge roller 2.

The rotating development sleeve 4*a* includes a magnet roll 4*b* at the center and is in contact with a restraining blade 4*c* on the peripheral surface thereof. The restraining blade 4*c* is used for coating the surface of the rotating development sleeve 4*a* with a thin layer of the toner t and the charge-accelerating particles m while charging the toner t and the charge-accelerating particles m. Then, the toner t and the charge-accelerating particles m adhering to the surface of the rotating development sleeve 4*a* are conveyed toward the development position a as the sleeve 4*a* rotates, and the toner image is formed by reversal development of the electrostatic latent image.

The rotating development sleeve 4*a* receives a development bias from a development-bias source S2. In the present embodiment, the development bias is obtained by superposing a DC voltage of −350 V and 1.8-kHz square AC voltage with a peak-to-peak voltage of 900 V. Thus, the toner image is formed on the photoconductor drum 1 by reversal development of the electrostatic latent image.

Developer t (Toner t)

The toner t is obtained by mixing binding resin, magnetic particles, and a charge control agent, and performing the steps of kneading, crushing, and classifying. Then, the charge-accelerating particles m and a plasticizer are added to the toner t. The weight mean diameter (D4) of the toner t is 7 μm.

Charge-Accelerating Particles m

The charge-accelerating particles m used in the step of charging the photoconductor are preferably nonmagnetic and nearly white or transparent so that they do not affect the image exposure step in which the latent image is formed. In addition, when color printing is performed, the charge-accelerating particles m are preferably colorless or white, considering the fact that some of them will be transferred onto the recording medium P from the photoconductor. Furthermore, the particle diameter of the charge-accelerating particles m is preferably smaller than the size of a single pixel so that light scattering can be prevented in the image exposure step.

The particle diameter of the charge-accelerating particles m is preferably 50 μm or less to ensure the uniformity in charging. In the present embodiment, if the charge-accelerating particles m are joining together to form aggregates, the average diameter of the aggregates is defined as the particle diameter.

The particle diameter is measured by observing the charge-accelerating particles m with an optical or electron microscope, selecting one hundred or more particles from among the observed particles, and determining the 50% average particle diameter in a particle volume distribution based on the maximum chord length in the horizontal direction.

One part by weight of the charge-accelerating particles m is added to one hundred parts by weight of the classified toner t. The charge-accelerating particles m and the toner t are uniformly mixed by a mixer, and are supplied to the development device 4.

The specific resistance of the charge-accelerating particles m must be $10^{12}$ Ω·cm or less for transferring electric charge via the particles. More preferably, the specific resistance of the charge-accelerating particles m is $10^{10}$ Ω·cm or less. In the present embodiment, the charge-accelerating particles m are composed of stannic oxide with a specific resistance of $10^6$ Ω·cm and an average particle diameter of 3 am. However, the material of the charge-accelerating particles m is not limited to stannic oxide. For example, conductive inorganic particles composed of other metal oxides, mixtures with organic materials, and particles obtained by treating the surfaces thereof may also be used as the charge-accelerating particles m.

The specific resistance is determined by a tablet method and normalization. More specifically, about 0.5 g of the particles are put into a cylinder with a base area of 2.26 $cm^2$, and the resistance between electrodes placed on top and bottom of the cylinder is measured while a load of 15 kg and a voltage of 100 V are applied to the electrodes. Then, the specific resistance is calculated by normalizing the measured resistance.

The charge-accelerating particles m may not only be in the form of primary particles but may also be in the form of secondary particles in which the particles join together to form aggregates. Thus, the aggregate state is not limited as long as the function of the charge-accelerating particles m is obtained.

Transfer Roller 5

The transfer roller 5 includes a core bar and a medium-resistance, elastic rubber layer surrounding the core bar. The core bar is composed of SUS according to Japanese Industrial Standard (JIS), aluminum, etc., and the medium-resistance, elastic rubber layer is composed of, for example, EPDM in which carbon black is dispersed, a rubber such as NBR, etc., with a volume resistivity of about $1\times10^5$ Ω·cm to $1\times10^{12}$ Ω·cm. The outer diameter of the transfer roller 5 is about 15 mm, and the Asker C hardness of the transfer roller 5 is about 35 degrees when a load of 6N is applied. In addition, the resistance of the transfer roller 5 according to the present embodiment is about $1\times10^8$ Ω when the room temperature is 23° C. and the humidity is 50%. The core bar of the transfer roller 5 is rotatably supported by bearings at both ends thereof, and the bearings are pressed toward the photoconductor drum 1 with a total weight of 7 N by springs, so that the transfer roller 5 is always in contact with the photoconductor drum 1. In addition, a predetermined transfer bias is applied to the transfer roller 5 by a transfer-bias source S3. The transfer roller 5 transfers the toner image formed on the photoconductor drum 1 onto the surface of the transfer medium P by receiving the transfer bias from the transfer-bias source S3.

The resistance of the transfer roller 5 is determined by pressing the transfer roller 5 against an aluminum drum with a diameter of 24 mm such that a total load of 6 N is applied to the core bar of the transfer roller 5 while rotating the transfer roller 5 at a constant peripheral speed of 85 mm/sec (=process speed PS or printing speed), applying a voltage of 2 kV between the core bar of the transfer roller 5 and the aluminum drum, and measuring the resistance between them.

Pre-Charge Exposure Device 7

The pre-charge exposure device 7 includes twelve light-emitting diodes (LEDs) for exposing the surface of the photoconductor drum 1. The construction of the pre-charge exposure device 7 is not particularly limited as long as it can remove the electric charge from the surface of photoconductor drum 1. For example, the pre-charge exposure device 7 may be constructed such that light emitted from several LEDs is guided with a light pipe so as to expose the photoconductor drum 1. Alternatively, a laser scanner using a polygon mirror may be used. Alternatively, the electric charge on the photoconductor drum 1 may be removed by bringing a discharge roller into contact with the photoconductor drum 1.

Toner-Recycling Process (Cleaner-Less Process)

The image-forming apparatus according to the present embodiment is free from a cleaning device and performs a toner-recycling process (hereafter called a "cleaner-less process"). Accordingly, no dedicated cleaning device is provided for removing the residual toner t remaining on the surface of the photoconductor drum 1 after the transfer step. The residual toner t is conveyed to the development position a via the nip region n as the photoconductor drum 1 rotates, and is collected and reused by the development device 4 in a simultaneous development and cleaning process. In the case in which reversal development is performed as in the image-forming apparatus according to the present embodiment, the simultaneous development and cleaning process is performed using an electric field for collecting the toner t placed in dark-potential regions of the photoconductor drum 1 to the development sleeve and an electric field for adhering the toner t to bright-potential regions of the photoconductor from the development sleeve.

Direct Charge (Charge Injection)

In the image-forming apparatus according to the present embodiment, the photoconductor drum 1 is charged by direct charge injection without causing electric discharge, using the charge roller 2 which is in contact with the photoconductor drum 1. The process of direct charge injection will be described below.

An adequate amount of the charge-accelerating particles m mixed with the toner t in the development device 4 are transferred onto the photoconductor drum 1 together with the toner t at the development position a in the development step performed by the development device 4.

The toner image formed on the photoconductor drum 1 is effectively transferred onto the transfer medium P in the nip region b between the transfer roller 5 and the photoconductor drum 1 when the transfer bias is applied. However, some of the toner t remains on the photoconductor drum 1 as residual toner. In addition, since the charge-accelerating particles m added to the toner t are conductive, they are not transferred onto the recording medium P and remain on the photoconductor drum 1. The charge-accelerating particles m adhering to the photoconductor drum 1 serve to increase the transfer efficiency when the toner image formed on the photoconductor drum 1 is transferred onto the recording medium P.

In the cleaner-less process performed in the image-forming apparatus according to the present embodiment, the residual toner t and the charge-accelerating particles m remaining on the photoconductor drum 1 after the transfer step are conveyed by the photoconductor drum 1 and supplied to the nip region n between the photoconductor drum 1 and the charge roller 2. Then, some of the toner t and the charge-accelerating particles m move onto the charge roller 2. Accordingly, the charge roller 2 charges the photoconductor drum 1 by contact charging while the charge-accelerating particles m are present in the nip region n.

The charge-accelerating particles m in the nip region n provides a lubricating effect, and accordingly the charge roller 2 can rotate such that its periphery slides along the periphery of the photoconductor drum 1 at a certain relative speed. In addition, the charge roller 2 is in stable contact with the photoconductor drum 1 since the charge-accelerating particles m are provided between them.

Since the charge roller 2 and the photoconductor drum 1 are rotated at different peripheral speeds, the chance for the charge-accelerating particles m to stay in contact with the photoconductor drum 1 in the nip region n is significantly increased, and high contact stability can be obtained.

In order to rotate the charge roller 2 and the photoconductor drum 1 at different peripheral speeds, according to the present embodiment, the charge roller 2 is directly rotated instead of being driven by the photoconductor drum 1. The charge roller 2 preferably rotates such that its periphery and the periphery of the photoconductor drum 1 move in opposite directions, so that the residual toner t conveyed to the nip region n is temporarily collected by the charge roller 2. Accordingly, direct charging can be effectively performed while the remaining toner t is temporarily removed from the photoconductor drum 1.

In addition, since the charge-accelerating particles m in the nip region n slide along the surface of the photoconductor drum 1 without gaps being provided, electric charge can be directly injected into the photoconductor drum 1 from charge roller 2. Accordingly, due to the charge-accelerating particles m, the charge roller 2 charges the photoconductor drum 1 mainly by direct charging (charge injection) without causing electric discharge.

Accordingly, in the image-forming apparatus according to the present embodiment, the charge potential of to the photoconductor drum 1 is approximately the same as the voltage applied to the charge roller 2. Therefore, when the charge roller 2 is used as a contact-charge member, the charge bias which must be applied to the charge roller 2 is equivalent to the charge potential of the photoconductor drum 1. Thus, an image-forming apparatus which can perform stable and safe contact charging without causing electric discharge is obtained.

Even if the charge-accelerating particles m fall off from the nip region n or the charge roller 2, the charge-accelerating particles m mixed with the toner t in the development device 4 are continuously replenished while the printer is being operated.

In addition, in the image-forming apparatus which performs the cleaner-less process according to the present embodiment, the charge-accelerating particles m discharged onto the photoconductor drum 1 from the nip region n or the charge roller 2 are collected by the development device 4 at the development position a, and are circulated by being mixed with the toner t again.

The charge-accelerating particles m may also be initially applied to the surface of the charge roller 2, so that the direct charging performance can be ensured from immediately after the start of the printer operation.

In the image-forming apparatus which performs the cleaner-less process, the residual toner remaining on the photoconductor drum 1 after the toner image has been transferred onto the recording medium P is conveyed to the nip region n and adheres to the charge roller 2. Since the toner t is normally insulative, there is a risk that the toner t adhering to the charge roller 2 will cause charge failure. However, since the charge-accelerating particles m are provided in the nip region n between the photoconductor drum 1 and the charge roller 2 in the image-forming apparatus according to the present embodiment, the charge roller 2 and the photoconductor drum 1 can continuously be in stable contact with each other and the contact resistance between the charge roller 2 and the photoconductor drum 1 can be maintained. Accordingly, low-voltage and ozone-free direct charging is reliably performed and the photoconductor drum 1 is uniformly charged for a long time, irrespective of the contamination of the charge roller 2 with the residual toner t.

When the amount of the charge-accelerating particles m in the nip region n is too small, sufficient lubricating effect cannot be obtained and the friction between the charge roller 2 and the photoconductor drum 1 increases. In such a case, it is difficult to rotate the charge roller 2 and the photoconductor drum 1 at different peripheral speeds. As a result, the driving torque becomes too high and there is a risk that the surfaces of the charge roller 2 and the photoconductor drum 1 will be damaged if the charge roller 2 is forcedly rotated. In addition, the contact stability cannot be sufficiently increased by the charge-accelerating particles m, and satisfactory charging performance cannot be obtained.

In contrast, when the amount of the charge-accelerating particles m in the nip region n is too large, the charge-accelerating particles m easily falls off the charge roller 2 and cause adverse effects on the image being formed.

It has been experimentally proven that the number of the charge-accelerating particles m in the nip region n is preferably in the range of $10^3$ to $5\times10^5$ per square millimeters. If the number of the charge-accelerating particles m is less than $10^3$ per square millimeters, sufficient lubricating effect and the effect of increasing the contact stability cannot be obtained, and the charging performance is degraded. If the number of the charge-accelerating particles m is more than $5\times10^5$ per square millimeters, a large number of the charge-accelerating particles m fall off onto the photoconductor drum 1. Therefore, the photoconductor drum 1 cannot be sufficiently exposed, irrespective of the light transmittance of the charge-accelerating particles m.

The number of the charge-accelerating particles m in the nip region n is preferably determined by directly observing the nip region n between the charge roller 2 and the photoconductor drum 1. However, since many of the particles m adhering to the photoconductor drum 1 are scraped off by the charge roller 2 which rotates such that its periphery and the periphery of the photoconductor drum 1 slide along each other in opposite directions, the number of the particles m included in a region on the surface of the charge roller 2 immediately before it reaches the nip region n is determined as the number of the particles m in the present embodiment.

More specifically, the surfaces of the photoconductor drum 1 and the charge roller 2 are photographed by a video microscope (OVM 1000N manufactured by Olympus Corporation) and a digital still recorder (DELTIS SR-3100 manufactured by Olympus Corporation) while the rotation of the photoconductor drum 1 and the charge roller 2 is stopped and no charge bias is applied.

When the surface of the charge roller 2 is photographed, the charge roller 2 is pressed against a slide glass under the same conditions as those used when the charge roller 2 is pressed against the photoconductor drum 1, and the surface of the charge roller 2 is photographed from behind the slide glass at 10 or more locations with the video microscope using an 1000× objective lens. Then, the obtained digital images are binarized using a certain threshold to separate the regions corresponding to the particles from the surrounding regions, and the number of the regions corresponding to the particles is counted using a predetermined image processing software program.

The amount of the charge-accelerating particles m on the photoconductor drum 1 is determined in a similar manner using the video microscope.

The amount of the charge-accelerating particles m in the nip region n is adjusted by changing the mixing ratio of the charge-accelerating particles m to the toner t in the development device 4. The number of the charge-accelerating particles m in the nip region n can be set in the above-described range by adding 0.01 to 20 parts by weight of the charge-accelerating particles m to one hundred parts by weight of the toner t.

In addition, the image-forming apparatus according to the present embodiment may perform a roller-cleaning-on mode (contact-charge-member-cleaning mode) in which the residual toner t adhering to the charge roller (contact-charge member) 2 is efficiently discharged from the charge roller 2 onto a non-image-forming region, such as a region corresponding to a gap between recording sheets. Accordingly, the contamination level of the charge roller 2 is maintained low and satisfactory charging performance and image-recording performance are ensured for a long time.

More specifically, the voltage is applied to the charge roller 2 in two voltage-applying modes: mode A (roller-cleaning-off mode) which is selected when an image is being formed and in which the photoconductor drum 1 is uniformly charged by applying a DC voltage; and mode B (roller-cleaning-on mode) which is selected when no image is being formed and in which a superposition of the DC voltage and an AC voltage (cleaning bias) is applied.

When an image is being formed by the printer and mode A is selected, the switch SW of the charge-bias source S1 is connected to the contact point A by a sequence control circuit (not shown in FIG. 1), and the DC power source $S_{DC}$ applies a DC voltage of −500 V to the core bar 2*a* of the charge roller 2. Accordingly, the surface of the photoconductor drum 1 is directly charged to about −500 V, which is approximately the same as the DC voltage applied to the core bar 2*a* of the charge roller 2. More specifically, when an image-forming region on the photoconductor drum 1 is in the nip region n, only the DC voltage is applied to the charge roller 2.

When no image is being formed and mode B is selected, the switch SW of the charge-bias source S1 is connected to a contact point B by the sequence control circuit (not shown), so that the DC power source $S_{DC}$ and an AC power source $S_{AC}$ are connected in series. Accordingly, the core bar 2*a* of the charge roller 2 receives a superposition of the DC voltage of −500 V and 200-Hz square AC voltage with a peak-to-peak voltage of 100 V. In mode B, the frequency of the AC voltage is adequately selected from the range of 5 Hz to 500 Hz. In addition, similar to the period in which an image is being formed, the development sleeve 4*a* of the development device 4 continuously receives a superposition of the DC voltage of −400 V and the 1.8-Hz square AC voltage with a peak-to-peak voltage of 900 V in mode B. Accordingly, the superposition of the AC and DC voltages are applied to the charge roller 2 when a non-image-forming region on the photoconductor drum 1 is in the nip region.

When the bias voltages are applied in the above-described manner, the toner t accumulating on the charge roller 2 is discharged onto the photoconductor drum 1 and is collected by the development device 4 by back contrast. Accordingly, the toner t adhering to the charge roller 2 is efficiently removed, so that the charging performance is maintained. Thus, the toner t adhering to the charge roller 2 is discharged onto the photoconductor drum 1 in the non-image-forming region thereof.

In addition, since the charge-accelerating particles m are supplied to the charge roller 2, the toner t is encouraged to leave the surface of the charge roller 2 and is easily discharged onto the photoconductor drum 1. Accordingly, the charge roller 2 contaminated with the toner t is efficiently cleaned. As a result, high-quality images can be formed continuously for a long time even after an image with a high image ratio has been output.

In order to effectively discharge the toner accumulating on the charge roller 2 onto the photoconductor drum 1 in mode B, the cleaning bias applied to the charge roller 2 is preferably set such that a potential difference between the photoconductor drum 1 and the charge roller 2 at a position in a downstream side of the nip region n in the rotating direction of the photoconductor drum 1 is increased. In the case in which the photoconductor drum 1 is charged by direct charging, as in the present embodiment, the potential applied to the surface of the photoconductor drum 1 (charging target) is approximately the same as that applied to the charge roller 2 (charging member). Therefore, the potential difference does not easily occur between the charge roller 2 and the photoconductor drum 1. Although it is necessary to uniformly charge the surface of the photoconductor drum 1 when an image is being formed, a potential difference is preferably provided by applying the AC bias (cleaning bias) in the roller-cleaning-on mode which is selected when, for example, no image is being formed.

Mechanism of Image Defects

Figure 2:
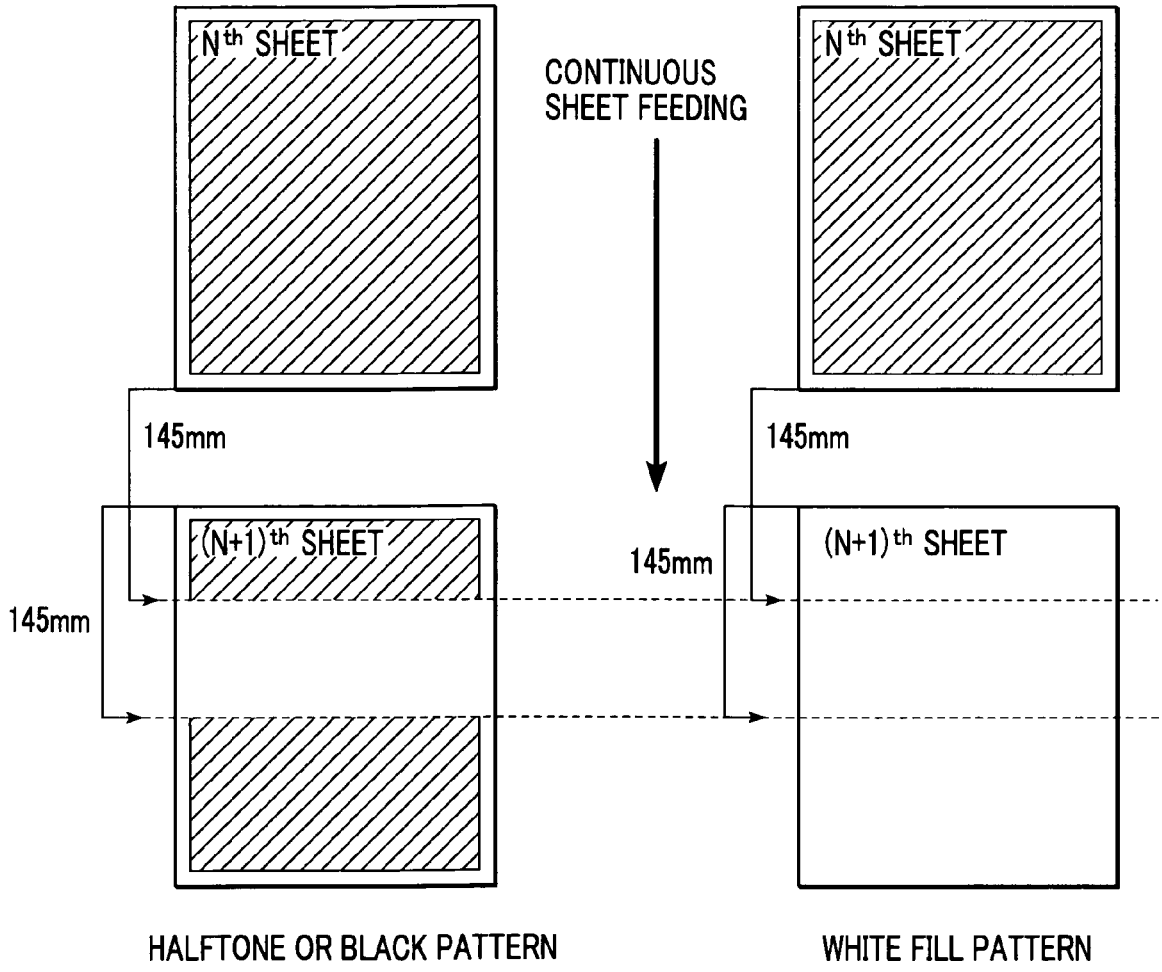
FIG. 2 is a diagram showing a position at which image defects appear.

FIG. 2 is a diagram showing a position at which image defects, such as light-blocking and fogging, caused due to the cleaner-less process appear. Normally, these image defects normally occur when continuous sheet feeding is performed and appear on the second or the following recording sheets in a band shape. The mechanism in which the image defects are formed will be described below.

Figure 3:
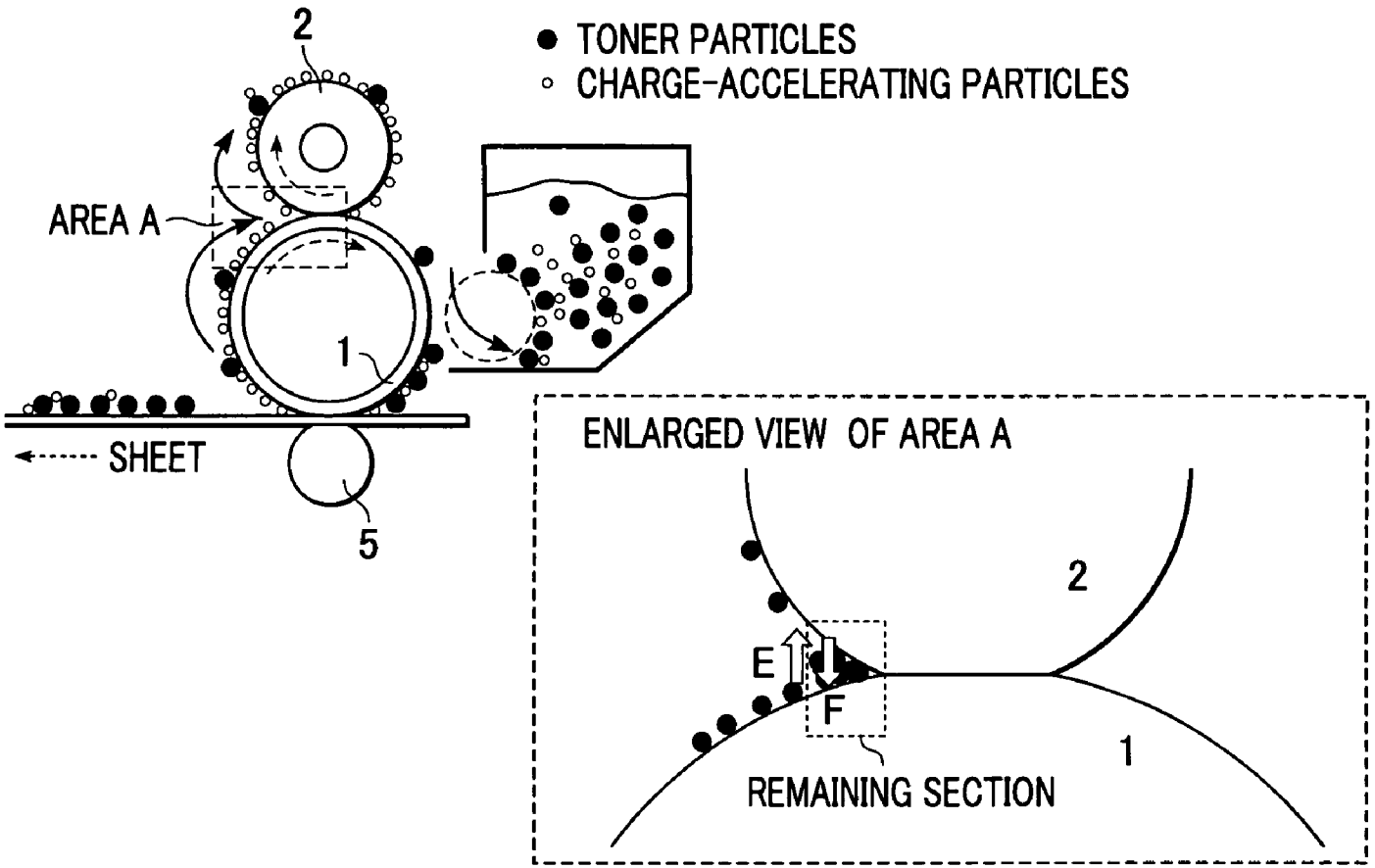
FIG. 3 is a diagram showing the mechanism by which the image defects occur.

FIG. 3 is a schematic diagram showing the mechanism in which the image defects are formed.

In the above-described cleaner-less process, when a pattern with a high image ratio (for example, a black fill pattern in which the density is maximum over the entire region or a 1 dot/1 space pattern in which a horizontal line is printed on every other pixel line) is formed, the amount of the residual toner t on the photoconductor drum 1 increases. Accordingly, the toner t which cannot adhere to the charge roller 2 accumulates in an area A, which is in an upstream side of the nip region n between the photoconductor drum 1 and the charge roller 2 in the rotating direction of the photoconductor drum 1, as accumulating toner A.

The accumulating toner A is pushed against the surface of the photoconductor drum 1 by a force F in an electric field E generated in accordance with the potential relationship between the surface of the photoconductor drum 1 and the surface of the charge roller 2. The residual toner t accumulates in the area A or adheres to the surface of the charge roller 2 depending on this potential relationship. For example, when a potential difference is generated such that the intensity of the electric field decreases compared to its history, the toner A accumulating in the area A moves onto the charge roller 2, rotates along with the charge roller 2, and is discharged onto the photoconductor drum 1, since the charge roller 2 and the photoconductor drum 1 rotate such that the peripheries thereof move in opposite directions in the nip region n (counter rotation). The thus discharged toner blocks the laser beam if it is in a region to be exposed, and the latent image cannot be formed in such a case. This leads to a defect called light-blocking, which leaves white dots on the recording sheet. Although the discharged toner does not block the laser beam if it is in a white-fill region, which is outside the region to be exposed, there is a risk that it cannot be completely collected in the development step. In such a case, the remaining toner reaches the nip portion b and appears on the recording sheet as fog.

Position of Image Defects

The position at which the image defects appear will be described below along with the steps of charging, exposure, development, transfer, etc., when continuous sheet feeding is performed.

Figure 4:
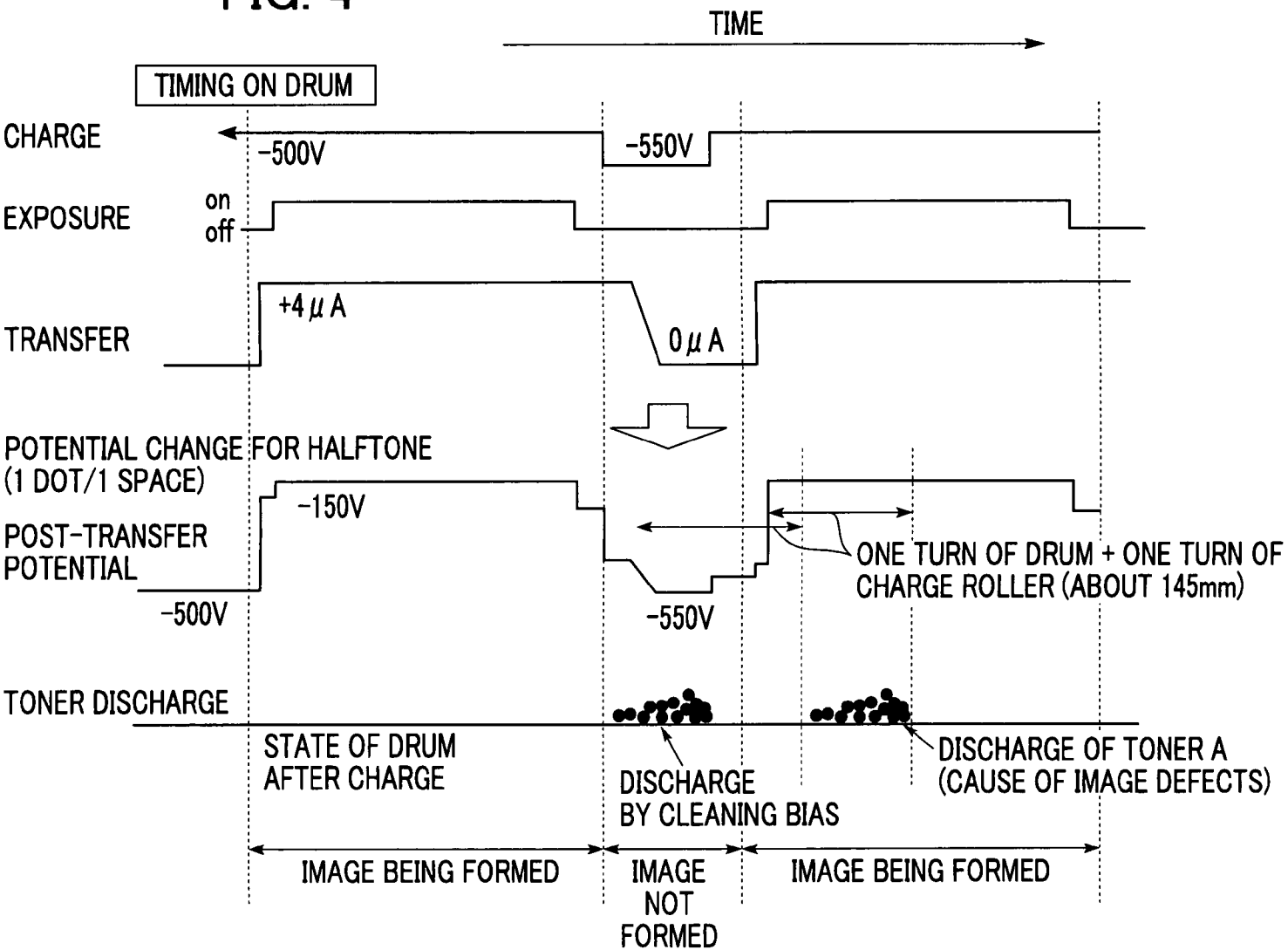
FIG. 4 is a timing chart showing the state of a photoconductor drum included in an image-forming apparatus according to a first comparative example which performs a cleaner-less process but is not provided with a pre-charge exposure device.

FIG. 4 is a timing chart showing the state of a photoconductor drum included in an image-forming apparatus according to a first comparative example which performs the cleaner-less process but is not provided with the pre-charge exposure device 7.

The central area in the figure shows the potential on the surface of the photoconductor drum 1 included in the image-forming apparatus according to the first comparative example after the transfer step (post-transfer potential) in the operation of forming an image including horizontal lines at 1 dot/1 space (600 dpi) on recording sheets which are supplied continuously.

When the image is being formed, the post-transfer potential of the photoconductor drum 1 is about −150 V and is higher than the charge potential (−500 V) due to the influence of charging, exposure, and transfer (potential contrast relative to the charge potential is 350 V). Although not shown in the figure, since the pre-charge exposure device 7 is not provided, the post-transfer potential of photoconductor drum 1 is about −50 V (potential contrast relative to the charge potential is 450 V) when a black fill pattern is being formed, and is about −450 V (potential contrast relative to the charge potential is 50 V) when a white fill pattern is being formed.

In the non-image-forming region, the image exposure by the laser beam is turned off, and the potential of the photoconductor drum 1 decreases accordingly. In addition, the transfer bias is reduced to prevent memory on the photoconductor drum 1 caused by the transfer bias. Accordingly, the post-transfer potential of the photoconductor drum 1 is about −500 V, and is approximately the same as the charge potential (potential contrast relative to the charge potential is 0 V). Alternatively, if the charge roller 2 is being cleaned, the post-transfer potential of the photoconductor drum 1 is about −550 V (potential contrast relative to the charge potential is −50 V).

The potential on the surface of the photoconductor drum 1 is measured by a surface voltmeter (Model 344 manufactured by Trek, Inc.)

In the sheet-feeding operation, the potential contrast relative to the charge potential is lowest in the non-image-forming region. Accordingly, when the non-image-forming region on the photoconductor drum reaches the nip region n on the photoconductor drum, the potential contrast significantly decreases and the toner A accumulating in the area A moves onto charge roller 2, rotates together with the charge roller 2 for one turn, and is discharged onto the photoconductor drum 1.

The influence of the accumulating toner A appears in the second or the following recording sheet, as shown in FIG. 2, at a position away from the front end of the region where the potential contrast is low by a distant corresponding to the sum of one turn of the photoconductor drum 1 and one turn of the charge roller 2 (in terms of the distance along the circumference of the photoconductor drum 1). Since the diameter of the photoconductor drum is 24 mm, one turn of the photoconductor drum corresponds to about 75 mm. In addition, the charge roller 2 (diameter is 18 mm) rotates at a peripheral speed of about 80% of that of the photoconductor drum 1 such that the periphery of the charge roller 2 and the periphery of the photoconductor drum 1 move in opposite directions, and therefore one turn of the charge roller 2 corresponds to about 70 mm in terms of the distance along the circumference of the photoconductor drum 1. Accordingly, the sum of one turn of the photoconductor drum 1 and one turn of the charge roller 2 (in terms of the distance along the circumference of the photoconductor drum 1) is calculated as about 145 mm.

If a print pattern varies in a single sheet, as in a graphic pattern, black fill patterns, halftone patterns, and white patterns are mixed in a single page. Accordingly, the amount of exposure varies in a single page, and therefore regions where the potential contrast is high and low are mixed in a single page. In such a case, light-blocking and fogging occur at a position behind the position where the potential contrast is low by about 145 mm.

Figure 5:
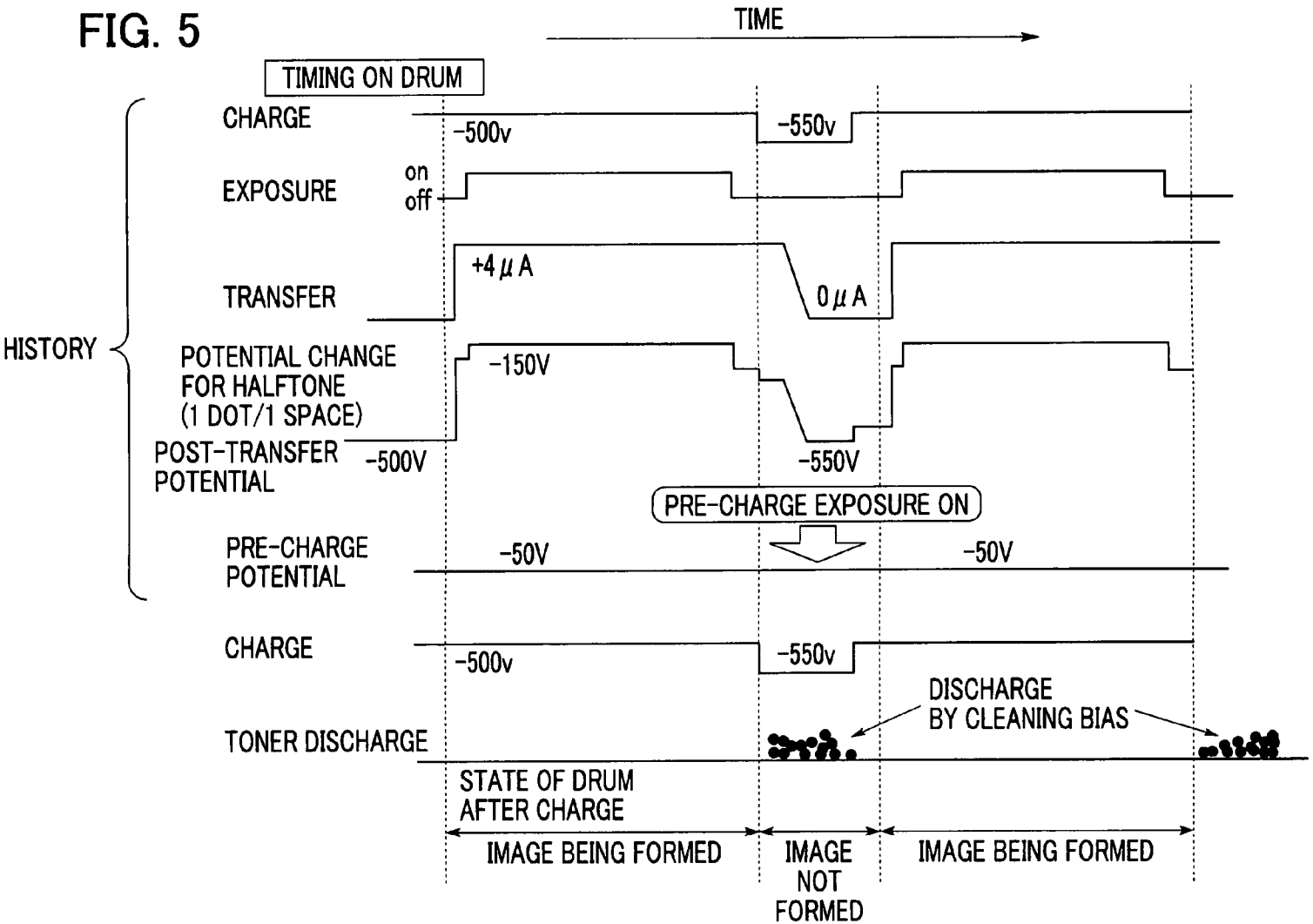
FIG. 5 is a timing chart showing a process sequence and the state of a photoconductor drum in an image-forming apparatus according to a second comparative example.

FIG. 5 is a timing chart showing a process sequence and the state of the photoconductor drum in an image-forming apparatus according to a second comparative example.

In the second comparative example, the pre-charge exposure device 7, which functions as a potential-difference controller (potential changing means), is provided at a pre-charge exposure position to prevent light-blocking and fogging in any type of graphic pattern. The pre-charge exposure device 7 removes the electric charge from the photoconductor drum 1 so as to increase the potential contrast between the surface of the photoconductor drum and that of the charge roller, thereby prevents light-blocking and fogging.

As shown in FIG. 5, in the second comparative example, the pre-charge exposure device 7 is always turned on while an image is being formed. Since the pre-charge exposure device 7 is always turned on, the pre-charge potential of the photoconductor drum 1 is reliably maintained at −50 V, and therefore light-blocking and fogging are prevented.

More specifically, the potential difference between the surface of the photoconductor drum 1 and the surface of the charge roller 2 at a position in an upstream side of the nip region n in the rotating direction of the photoconductor drum 1 is increased, at least while the image is being formed, so that the toner A accumulating in the area A is restrained in the area A. Thus, the toner A is prevented from being discharged while the image is being formed, and light-blocking and fogging, which are the defects caused by the toner remaining on the charge roller, are prevented.

Figure 6:
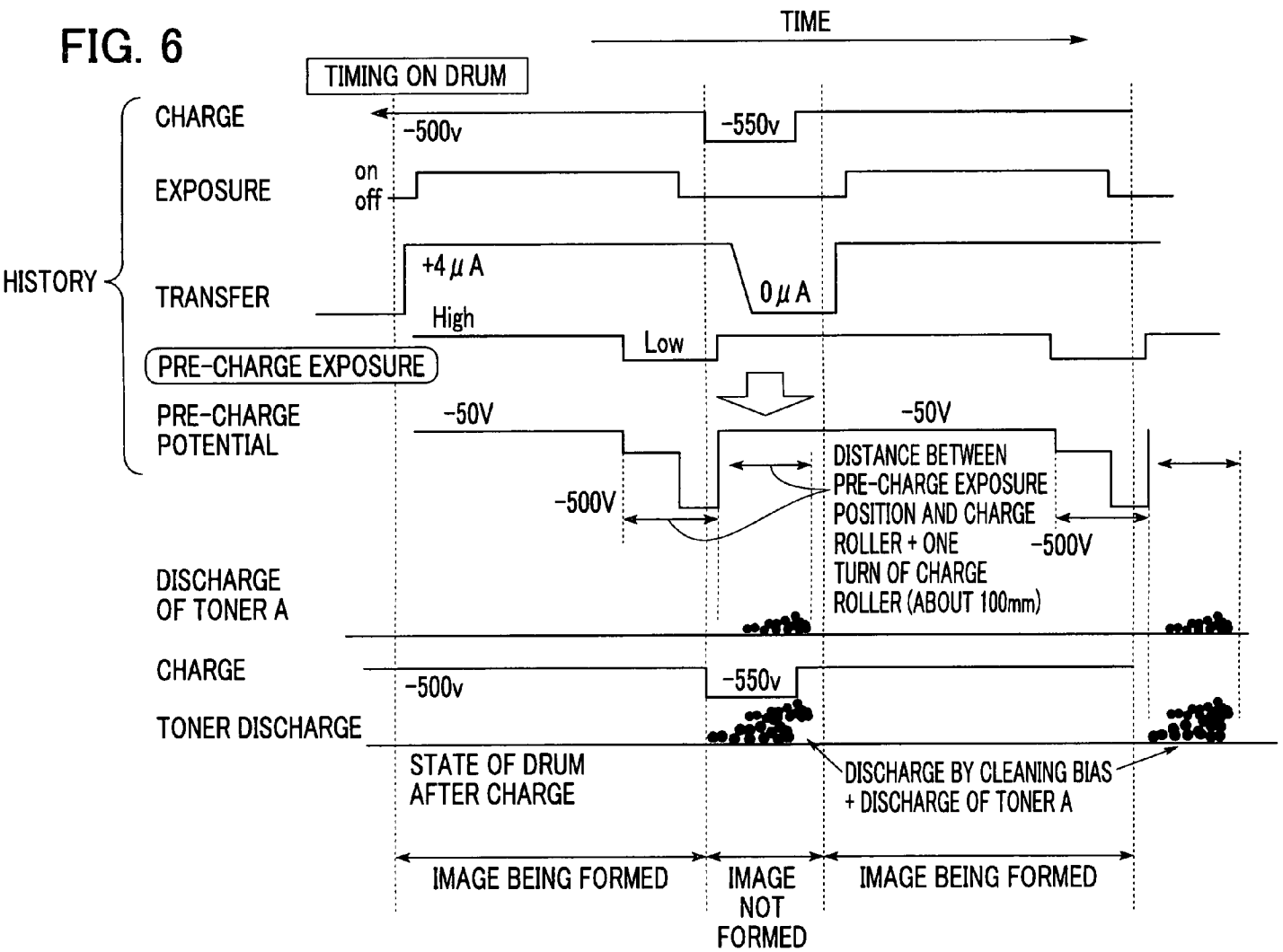
FIG. 6 is a timing chart showing a process sequence and the state of the photoconductor drum in the image-forming apparatus according to the embodiment of the present invention.

FIG. 6 is a timing chart showing a process sequence and the state of the photoconductor drum in the image-forming apparatus according to the embodiment of the present invention.

In the image-forming apparatus according to the embodiment, the pre-charge exposure device 7, which functions as the potential changing means for changing the potential of the photoconductor drum 1, is controlled with a predetermined process sequence so as to change the intensity of pre-charge exposure. This will be described in more detail below.

When the image-forming apparatus forms images while continuous sheet feeding is performed, the amount of toner A accumulating in the area A gradually increases, and eventually exceeds a certain limit. Accordingly, the toner A is discharged from the area A and moves onto the charge roller 2, thereby causing light-blocking and fogging. In order to prevent this, in the present embodiment, the pre-charge exposure device 7 changes the amount of exposure when continuous sheet feeding is performed. More specifically, the pre-charge exposure device 7 performs the sequence control shown in FIG. 6, and changes the intensity of the pre-charge exposure so that the toner A is discharged onto the photoconductor drum 1 in the non-image-forming region thereof.

More specifically, the pre-charge exposure device 7 is turned on or the amount of exposure is set high when the latent-image-forming unit 3 starts forming the latent image on the photoconductor drum 1, and is turned off or the amount of exposure is set low a predetermined period before the time at which the latent-image-forming unit 3 finishes forming the latent image on the photoconductor drum 1 and stops exposing the photoconductor drum 1 at the front end of the non-image-forming region. Accordingly, the pre-charge exposure device 7 is turned on or the amount of exposure is set high when the toner A is not be discharged onto the photoconductor drum 1 from the charge roller 2, and is turned off or the amount of exposure is set low when the toner A is to be discharged onto the photoconductor drum 1 from the charge roller 2.

According to the above-described sequence control of the pre-charge exposure device 7, when the pre-charge exposure device 7 is turned on or the amount of exposure is set high, the pre-charge potential of the photoconductor drum 1 is about −50 V and the potential contrast between the charge roller 2 and the photoconductor drum 1 is high, so that the toner A is restrained in the area A. In contrast, when the pre-charge exposure device 7 is turned off or the amount of exposure is set low, the pre-charge potential of the photoconductor drum 1 is about −500 V and the potential contrast between the charge roller 2 and the photoconductor drum 1 is low, so that the toner A is discharged from the area A. In order to set the pre-charge potential to −500 V as described above, the image exposure for forming the latent image is preferably turned off in advance in the region where this pre-charge potential is to be obtained, so that the charge potential can be prevented from being attenuated.

In order to discharge the accumulating toner onto the photoconductor drum 1 in the non-image-forming region thereof, that is, in the region where the photoconductor drum 1 will not be exposed by the latent-image-forming unit 3, the pre-charge exposure device 7 must be turned off or the amount of pre-charge exposure must be set low a predetermined period t (sec) before the time at which the front end of the non-image-forming region reaches the exposure position at which the latent-image-forming unit 3 exposes the photoconductor drum 1. The period t is calculated as $t=\{(L_1+L_2)/V_{dc}+\pi a/V_c\}$ where $L_1$ is the distance between the exposure position of the pre-charge exposure device 7 and the nip region n along the periphery of the photoconductor drum 1, $L_2$ is the distance between the nip region n and the exposure position of the latent-image-forming unit 3 along the periphery of the photoconductor drum 1, a is the diameter of the charge roller 2, $V_c$ (mm/s) is the peripheral speed of the charge roller 2, and $V_{dc}$ (mm/s) is the peripheral speed of the photoconductor drum 1. In the present embodiment, the position of the nip region n is defined as the center of the nip width since the nip region n has a predetermined length along the periphery of the photoconductor drum 1.

According to the present embodiment, the diameter of the photoconductor drum 1 is 24 mm and that of the charge roller 2 is 18 mm. Accordingly, the pre-charge exposure device 7 is turned off or the amount of exposure is set low at a position ahead of the front end of the non-image-forming region on the surface of the photoconductor drum 1 by a distance a distance calculated as the sum of a distance corresponding to one turn of the charge roller 2 (calculated to be about 70 mm) and the distance between the exposure position of the pre-charge exposure device 7 and the nip region n (30 mm in the present embodiment), that is, by 100 mm.

Thus, the pre-charge exposure device 7 changes the potential on the surface of the photoconductor drum 1 such that the potential difference between the charge roller 2 and a toner-discharge region (first region) on the photoconductor drum 1 is lower than the potential difference between the charge roller 2 and a region (second region) on the photoconductor drum 1 located on a downstream side of the toner-discharge region in the rotating direction of the photoconductor drum 1. The first region is in an upstream side of a predetermined position of the image carrier in the moving direction of the image carrier and the second region is in an downstream side of the predetermined position. The predetermined position is a predetermined position located between the first region and the second region. The toner-discharge region is a region on the photoconductor drum 1 where the toner adhering to the charge roller 2 is discharged, and is at least a part of the non-image-forming region on the photoconductor drum 1.

The toner-discharge region is located in an upstream side region of a position apart from the front end of a region to be the non-image-forming region on the photoconductor drum 1 by a distance corresponding to one turn of the charge roller 2 in the moving direction of the photoconductor drum 1. In addition, the toner-discharge region is preferably located in a downstream side region of a position apart from the back end of a region to be the non-image-forming region on the photoconductor drum 1 by the distance corresponding to one turn of the charge roller 2 in the moving direction of the photoconductor drum 1.

When the toner A is discharged at the above-described time, the toner A moves onto the charge roller 2 from the area A, is discharged onto the photoconductor drum 1 in the non-image-forming region thereof, and is efficiently collected by the development device 4. Accordingly, light-blocking and fogging can be prevented for a long time even when continuous sheet feeding is performed.

Advantages of the above-described embodiment of the present invention will be discussed below by comparing the embodiment (on/off of the pre-charge exposure is controlled) with the first comparative example (the pre-charge exposure is not performed) and the second comparative example (the pre-charge exposure is continuously turned on).

For the purpose of comparison, continuous sheet feeding was performed, and light-blocking and fogging in images printed on first, second, tenth, and one hundredth sheets were observed and evaluated using the evaluation criterion mentioned below. The printed pattern was a halftone image of 1 dot/1 space.

The result of the evaluation is shown in Table 1. In the table, "Good" means neither light-blocking nor fogging were observed, "Average" means acceptable light-blocking and fogging were observed, and "Bad" means unacceptable light-blocking and fogging were observed.

TABLE 1

| | First Sheet | Second Sheet | Tenth Sheet | Hundredth Sheet |
|---|---|---|---|---|
| First Comparative Example | Good | Bad | Bad | Bad |
| Second Comparative Example | Good | Good | Average | Bad |
| Embodiment | Good | Good | Good | Good |

As is clear from Table 1, the second comparative example and the embodiment are more effective in preventing light-blocking and fogging than the first comparative example when the continuous sheet feeding is performed. In particular, light-blocking and fogging are extremely effectively prevented in the embodiment, and dot not occur even after a large number of sheets have been processed.

Although light-blocking and fogging in the second and the following sheets in the continuous sheet-feeding operation are mainly discussed above, the present invention is not limited to this. For example, according to the present invention, light-blocking and fogging can also be prevented in the case in which the residual toner is adhered to the charge roller before the start of the printer operation and the potential applied in pre-print rotation is low.

As described above, the potential changing means (pre-charge exposure device) changes the potential difference between the surface of the image carrier (photoconductor drum) and the surface of the charging member (charge roller) at a position in an upstream side of the contact region (nip region) between the image carrier and the charging member in the moving direction of the image carrier, and thereby changes a force which restrains the toner accumulating in the contact region. Accordingly, the time at which the residual toner is discharged from the charging member onto the image carrier can be adequately controlled.

Therefore, the residual toner is prevented from being accidentally discharged onto the image carrier in the image-forming region thereof. Accordingly, the residual toner is prevented from causing an image defect by blocking the exposure or causing other image defects such as fogging.

In addition, since the charging member rotates such that the periphery of the charging member and the periphery of the image carrier move in opposite directions in the contact region, the residual toner adhering to the image carrier is once separated from the image carrier and moves onto the charging member. Accordingly, the charging member can directly charge the surface of the image carrier, and the image carrier is effectively charged. In addition, since the periphery of the charging member slides along the periphery of the image carrier at a certain relative speed, the toner pattern of the image formed in the previous cycle is destroyed and is prevented from appearing as a ghost in a halftone image.

While the present invention has been described with reference to what are presently considered to be the preferred embodiment, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image-forming apparatus comprising:

an image carrier;

a rotating charging member for charging the image carrier, the charging member being in contact with the image carrier and rotating such that the periphery of the charging member and the periphery of the image carrier move in opposite directions in a contact region between the image carrier and the charging member; and potential changing means for changing the potential of the image carrier before the image carrier is charged by the charging member, the potential changing means changing the potential of the image carrier such that a potential difference between a first region on the image carrier and the charging member is lower than a potential difference between a second region on the image carrier and the charging member, the first region being in an upstream side of a predetermined position of the image carrier in the moving direction of the image carrier and the second region being in an downstream side of the predetermined position, the predetermined position being in an upstream side region of a position apart from the front end of a region to be a non-image-forming region on the image carrier by a distance corresponding to one turn of the charging member in the moving direction of the image carrier.

2. An image-forming apparatus according to claim 1, wherein developer adhering to the charging member moves onto the image carrier in the first region of the image carrier.

3. An image-forming apparatus according to claim 2, wherein the developer stays in an upstream region of the contact region in the moving direction of the image carrier while the predetermined position on the image carrier is moving toward the contact region, and moves onto the charging member when the predetermined position on the image carrier reaches the contact region.

4. An image-forming apparatus according to claim 1, further comprising:

development means for developing an electrostatic image formed on the image carrier with developer, the development means collecting the developer remaining on the image carrier.

5. An image-forming apparatus according to claim 1, wherein the image carrier is a photoconductor and the potential changing means comprises pre-charge exposure means for exposing the image carrier at a position in a downstream side of a transfer position and in an upstream side of the contact region in the moving direction of the image carrier, a developer image formed on the image carrier being transferred onto an image-receiving medium at the transfer position.

6. An image-forming apparatus according to claim 5, wherein the pre-charge exposure means sets the amount of exposure in the first region of the image carrier lower than the amount of exposure in the second region of the image carrier.

7. An image-forming apparatus according to claim 5, wherein the pre-charge exposure means exposes in the second region of the image carrier and does not expose in the first region of the image carrier.

8. An image-forming apparatus according to claim 1, wherein a voltage applied to the charging member when the first region on the image carrier is in the contact region is different from a voltage applied to the charging member for charging the image carrier.

9. An image-forming apparatus according to claim 1, wherein an AC voltage is applied to the charging member when the first region on the image carrier is in the contact region.

10. An image-forming apparatus according to claim 1, wherein the charging member is a charge roller.

11. An image-forming apparatus according to claim 1, wherein conductive particles are disposed in the contact region.

12. An image-forming apparatus according to claim 11, wherein the number of conductive particles disposed in the contact region is in the range of $10^3$ to $5\times10^5$ per square millimeters.

13. An image-forming apparatus comprising:

an image carrier;

a rotating charging member for charging the image carrier, the charging member being in contact with the image carrier and rotating such that the periphery of the charging member and the periphery of the image carrier move in opposite directions in a contact region between the image carrier and the charging member; and potential changing means for changing the potential of the image carrier before the image carrier is charged by the charging member, the potential changing means changing the potential of the image carrier such that a potential difference between a first region on the image carrier and the charging member is lower than a potential difference between a second region on the image carrier and the charging member, the first region being on an upstream side of the second region in the moving direction of the image carrier, wherein the first region is in an upstream side region of a position apart from the front end of a region to be a non-image-forming region on the image carrier by a distance corresponding to one turn of the charging member in the moving direction of the image carrier, and is in a downstream side region of a position apart from the back end of a region to be a non-image-forming region on the image carrier by the distance corresponding to one turn of the charging member in the moving direction of the image carrier.

14. An image-forming apparatus according to claim 13, wherein developer adhering to the charging member moves onto the image carrier in the first region of the image carrier.

15. An image-forming apparatus according to claim 14, wherein the developer stays in an upstream region of the contact region in the moving direction of the image carrier while the predetermined position on the image carrier is moving toward the contact region, and moves onto the charging member when the predetermined position on the image carrier reaches the contact region.

16. An image-forming apparatus according to claim 13, further comprising:

development means for developing an electrostatic image formed on the image carrier with developer, the development means collecting the developer remaining on the image carrier.

17. An image-forming apparatus according to claim 13, wherein the image carrier is a photoconductor and the potential changing means comprises a pre-charge exposure means for exposing the image carrier at a position in a downstream side of a transfer position and in an upstream side of the contact region in the moving direction of the image carrier, a developer image formed on the image carrier being transferred onto an image-receiving medium at the transfer position.

18. An image-forming apparatus according to claim 17, wherein the pre-charge exposure means sets the amount of exposure in the first region of the image carrier lower than the amount of exposure in the second region of the image carrier.

19. An image-forming apparatus according to claim 17, wherein the pre-charge exposure means exposes in the second region of the image carrier and does not expose in the first region of the image carrier.

20. An image-forming apparatus according to claim 13, wherein a voltage applied to the charging member when the first region on the image carrier is in the contact region is different from a voltage applied to the charging member for charging the image carrier.

21. An image-forming apparatus according to claim 13, wherein an AC voltage is applied to the charging member when the first region on the image carrier is in the contact region.

22. An image-forming apparatus according to claim 13, wherein the charging member is a charge roller.

23. An image-forming apparatus according to claim 13, wherein conductive particles are disposed in the contact region.

24. An image-forming apparatus according to claim 23, wherein the number of conductive particles disposed in the contact region is in the range of $10^3$ to $5\times10^5$ per square millimeters.

* * * * *